US010472872B2

(12) United States Patent
Ingram et al.

(10) Patent No.: US 10,472,872 B2
(45) Date of Patent: Nov. 12, 2019

(54) WINDOW THAT CAN BOTH SLIDE OPEN AND PIVOT OPEN

(71) Applicant: Invisifold Limited, Southampton (GB)

(72) Inventors: Neil Ingram, Southampton (GB); Stephen Smith, Southampton (GB)

(73) Assignee: INVISIFOLD LIMITED, Southampton (GB)

( * ) Notice: Subject to any disclaimer, the term of this patent is extended or adjusted under 35 U.S.C. 154(b) by 87 days.

(21) Appl. No.: 15/537,404

(22) PCT Filed: Dec. 7, 2015

(86) PCT No.: PCT/GB2015/053742
§ 371 (c)(1),
(2) Date: Jun. 17, 2017

(87) PCT Pub. No.: WO2016/097691
PCT Pub. Date: Jun. 23, 2016

(65) Prior Publication Data

US 2017/0370146 A1 Dec. 28, 2017

(30) Foreign Application Priority Data

Dec. 18, 2014 (GB) ..... 1422581.7

(51) Int. Cl.
*E05D 15/58* (2006.01)
*E06B 3/50* (2006.01)

(52) U.S. Cl.
CPC ..... *E05D 15/58* (2013.01); *E06B 3/509* (2013.01); *E06B 3/5072* (2013.01); *E05D 2015/586* (2013.01)

(58) Field of Classification Search
CPC ... E05D 15/58; E05D 15/0608; E05D 15/063; E05D 15/066; E05D 2015/586; E05D 2015/587; E05D 2015/588
See application file for complete search history.

(56) References Cited

U.S. PATENT DOCUMENTS 3,303,612 A * 2/1967 Baker ..... E05D 15/58 49/127
5,272,839 A * 12/1993 Karhu ..... E05D 15/58 16/95 R (Continued)

*Primary Examiner* — Justin B Rephann
(74) *Attorney, Agent, or Firm* — Crose Law LLC; Bradley D. Crose

(57) ABSTRACT

Conventional UPVC windows have casements which are pivotable and movable in a limited manner relative to the frame. It is desirable to be to move all the casements such that substantially the entire the frame is opened. This is achieved by providing a window (10) comprising a frame (20) including a head (22), a sill (24), the window further comprising at least first and second casements, wherein the first casement includes hinges (50) for rotating it relative to the frame, the hinges being movable relative to the frame along channels (120) provided in the sill and head such that the first casement is slidable within the frame, the first casement also including at least one guide (52) located on the upper and/or lower surface of the first casement distal from the hinges and movable within the respective head or sill channel as the first casement slides relative to the frame, the said at least one guide disengagable from the respective head or sill channel allowing the at least one guide to pass out of the respective channel thus allowing the first casement to be opened relative to the frame, the sill including a runner (140) on which the casement is slidable. In this way the first casement may be stacked adjacent the second casement at one end of the window frame after both have been pivoted open.

15 Claims, 7 Drawing Sheets

(56) References Cited

U.S. PATENT DOCUMENTS 5,749,172 A * 5/1998 Isopahkala ..... E05D 15/0604 49/124
6,301,833 B1 * 10/2001 Airikkala ..... E05D 15/58 160/196.1
6,397,522 B1 * 6/2002 Nussbaum ..... E05B 53/003 49/127
6,553,715 B1 * 4/2003 Lonnberg ..... E05D 15/0608 160/196.1
7,260,916 B2 * 8/2007 Sarnell ..... E04B 2/827 160/196.1
8,381,443 B2 * 2/2013 Smith ..... E05D 15/48 49/125
8,978,302 B2 * 3/2015 Ona Gonzalez .... E05D 15/0608 49/125
9,316,042 B2 * 4/2016 Goldenberg ..... E06B 3/5054
9,470,038 B2 * 10/2016 Ona-Gonzalez .... E05D 15/0604
9,745,787 B2 * 8/2017 Conley ..... E06B 3/924
10,119,315 B2 * 11/2018 Schneider ..... E05D 15/58
2005/0229512 A1 * 10/2005 Sarnell ..... E04B 2/827 52/236.7
2005/0284024 A1 * 12/2005 Bjorkman ..... E05D 15/58 49/176
2007/0169899 A1 * 7/2007 Cianciolo ..... E05D 15/08 160/211
2011/0094161 A1 * 4/2011 Rees ..... E05D 15/48 49/260
2012/0061033 A1 * 3/2012 Ona Gonzalez .... E05D 15/0608 160/205
2012/0159851 A1 * 6/2012 Seymour ..... E05D 15/58 49/177
2013/0306251 A1 * 11/2013 Ona Gonzalez .... E05D 15/0608 160/127
2014/0130417 A1 * 5/2014 Schneider ..... E05D 15/58 49/177
2016/0251885 A1 * 9/2016 Conley ..... E06B 3/924 49/127

* cited by examiner

WINDOW THAT CAN BOTH SLIDE OPEN AND PIVOT OPEN

The present invention relates generally to a window and finds particular, although not exclusive, utility in uPVC windows.

Traditional windows are openable in several ways such as being moved vertically upwards or downwards, as in the case of sash windows, and being hingedly openable such that one side of the window remains substantially stationary relative to the window frame, as in casement windows.

Other types of windows are known such as so-called "tilt and turn" windows, and "curtain" windows, the latter being slidable relative to the frame. With regard to these latter windows it is known to be able to rotate each panel relative to the frame and slide them along a track such that they "stack" up at one end thus creating a relatively large opening. Such a system is known from US2011/0088326A1.

However, this known system is directed at windows having aluminium frames and being of relatively large size. Accordingly, the system is relatively heavy and requires relatively substantial structures to support it. Moreover, the system is typically not used in situations where the windows form the primary building envelope closure. In other words, they are used to keep wind from a terrace with the building having a separate set of windows acting as the primary seal against the elements.

It is desirable to have a system which allows typical domestic windows, which do form the primary weather seal, to be moved relative to the frame such that substantially the whole of the frame is opened in one unbroken space.

In a first aspect, the invention provides a window comprising a frame including a head and a sill, the window further comprising at least first and second casements, wherein the first casement includes hinges for rotating it relative to the frame, the hinges being movable relative to the frame along channels provided in the sill and head such that the first casement is slidable within the frame, the first casement also including at least one guide located on the upper and/or lower surface of the first casement distal from the hinges and movable within the respective head or sill channel as the first casement slides relative to the frame, the said at least one guide disengagable from the respective head or sill channel allowing the at least one guide to pass out of the respective channel thus allowing the first casement to be opened relative to the frame, the sill including a runner on which the casement is slidable.

The window may also comprise two side jams or side frame members.

In this way, the window system is openable and slidable relative to the frame such that substantially the whole of the frame may be opened in one unbroken space.

The windows may be single, double or triple glazed. They may comprise uPVC frames and casement members although other materials are contemplated such as aluminium and wood.

The guide is trapped within the respective channel such that it can substantially only move reciprocatively along the frame in a direction parallel to the glass panes in the casement with it in its closed (un-pivoted) positions.

The term "runner" may mean a relatively long, thin member. The runner may be metallic. For instance, the runner may comprise an aluminium extrusion. The runner may be relatively narrow such as in the range 5 to 15 mm wide. The runner may have a height in the range 5 to 20 mm. The runner may extend continuously along the sill or it may be arranged discontinuously in more than one length.

The runner may be located outwardly of the channel. For instance, the runner may be inserted into a groove along one long side of the sill. The groove may have been formed in the sill for use with gaskets or seals (a beading socket). For instance, in uPVC window frames which are moulded by extrusion a groove is formed for the insertion of the gaskets or seals which hold the glass in place.

Alternatively, the runner may be formed integrally with the sill. This may be the case where the window frame itself is formed of extruded aluminium.

The runner may be arranged to raise, or distance, the casement away from the base of the sill channel. In this way, the runner may be arranged to carry substantially all of the weight of the casement. In this respect, the casement may still contact with the base of the sill channel but the weight is carried by the runner. Alternatively, the casement may not contact with the base of the sill channel. The runner may provide an advantage of a rigid, robust member where the sill is formed of material which may bend, such as uPVC.

The first casement may include a guide on its upper and lower surfaces. The frame may include a sill channel and a head channel. The channels may be defined by a rear surface of the frame on one side and by a lip at the front of the frame on the other side. The lip may be retro-fittable to an existing frame. The lip may be the runner. However, the channel(s) may be initially separate and retro-fitted to an existing frame.

The respective head or sill channel may include a guide slot for allowing the said at least one guide to be disengaged therefrom. The term 'disengage' may be understood to mean that the guide may be released from the channel.

The guide slot may be located in the lip forming one sidewall of the channel.

Alternatively, or additionally, the first casement may include guide control means for retracting and extending the said at least one guide relative to the first casement. In this way the guide(s) may be retracted relative to the casement to allow the casement to hingedly open relative to the frame. The control means may be biased to the extended position and retracted by temporarily overcoming the biasing means. For instance, the guide(s) may be biased by a spring and the control means may mechanically pull the guide(s) against the spring to retract it.

The frame may include at least one sliding surface comprising relatively low friction material to ease the sliding of the first casement relative thereto. The material may be TEFLON® although other such low friction materials are contemplated. The sliding surface may extend along the base of the channel(s).

The at least one sliding surface may be arranged on the underside of the first casement for contact with the runner. The sliding surface may extend along the upper and lower surfaces of the casement sides. The sliding surface may be provided continuously or discontinuously along the underside of the first casement.

At least one hinge may comprise a first part having an approximate quadrant shape and a second part having a rectilinear portion, wherein the parts are pivoted to one another and the first part is arrangeable on the upper or lower surface of the hinge side of the first casement and the second part is slidable along the respective channel.

The first part may include a piece extending away perpendicularly from the plane of the quadrant for fixing to the side of the casement (or mullion portion attached to the side of the casement) in a vertical manner.

It is contemplated that the first casement may comprise such a hinge on both its upper and lower surfaces. The hinges may be located towards one end of each of the upper and lower surfaces.

In this way, the casement is rotatable relative to the frame with the second part(s) remaining within the channel(s) and the first part(s) rotating with the casement.

The frame may include a landing strip at the point where the hinge of the first casement is positioned for rotatable opening. The landing strip may comprise a side wall to reduce the width of the respective channel such that it is approximately equal to the width of the second part. This may provide additional resilience and stability in the system when the casement is rotatably opened as it may hold the hinge steady.

The landing strip may be located on the sill and may include a surface to spread the weight of the first casement across the frame. In other words, it may prevent the first casement dropping or lowering, relative to the frame, by preventing deformation of the frame. In this regard, the weight of the casement is borne by the runner with the casement in its unopened position. However, when the casement is rotated to its open position the weight is transferred to the hinge and thus the load is concentrated on a relatively small area. This may help to prevent an upper hinge from leaving the head channel which otherwise may occur due to substantially all of the weight of the casement being borne by the hinge, located on the lower surface of the casement, and the casement tilting outwardly at the top.

The surface may comprise metal. The landing strip may be entirely made from metals and may comprise aluminium. The landing strip may be entirely made from plastics. A landing strip may also be located in the head of the frame.

The frame may include at least one hinge slot in each of the side of the head and sill channels for allowing the first part of the hinges to pass at least partially out of the respective channel as the casement is rotatably opened. The hinge slots may be located in the sidewalls of the channels and may be in the lip forming one sidewall of the channels.

One side of the sill channel may be formed by the runner and the hinge slot in the side of the sill channel may be formed by an absence of the runner.

The hinge slots may include a sidewall lying at an angle less than 80 degrees relative to a plane parallel with the surface of the glass panes in the closed (unrotated) position. In this way, a side of the quadrant may be supported by the said sidewall as the first casement is rotatably opened.

The angle may be between 25 and 70 degrees. The angle may be approximately 45 degrees.

The said at least one hinge slot may include a curved sidewall relative to a plane parallel with the surface of the glass windows in the closed position. The radius of curvature may be approximately equal to the radius of curvature of the quadrant forming the first part of the hinge.

A side of the quadrant may be supported by the said sidewall as the first casement is opened.

It is contemplated that a reinforcing gate member may be inserted into at least one of the hinge slots, preferably the sill hinge slot. In this case it is the sidewall of the reinforcing gate member which may have the features as described above relating to the angle of repose or being curved.

In this case it may be the sidewall of the gate which supports a side of the quadrant as the first casement is rotatably opened. In other words, the sidewall of the hinge slot may be replaced by the sidewall of the reinforcing gate member.

Furthermore, the reinforcing gate member and the landing strip may be unitary. This may simplify manufacture and installation and provide a more rigid support structure.

The first and second casements may completely fill the frame in their closed positions such that the first casement is only slidably movable relative to the frame after the second casement has been rotatably opened, the second casement comprising hinges which allow it to be opened relative to the frame, and the at least one guide slot being located in the respective head or sill channel such that the first casement is only openable after it has been slidably moved relative to the frame.

In this way, the first casement may only move reciprocatively within the frame until such time as the guide has left the confines of the channel.

The position of the hinge slot(s) and/or guide slot(s) may be selectively positioned relative to the channels so as to only allow the rotation (opening) of the first casement relative to the frame with the first casement in certain positions relative to the frame. Several guide slots and/or hinge slots may be provided to allow the first casement to be rotated relative to the frame at more than one position relative to the frame.

The window may be arranged such that the first and second casements are openable by approximately 90 degrees relative to the frame, and the first casement being positionable in this open position immediately adjacent the second casement so as to provide a relatively wide opening in the frame.

The window may comprise more than two casements wherein each casement is openable by approximately 90 degrees relative to the frame, and the casements being positionable in this open position immediately adjacent one another so as to provide a relatively wide opening in the frame.

In either situation, the casements may be "stacked", in a side-by-side manner, at one end of the frame.

In a second aspect, the invention provides a window comprising a frame including a head, a sill, and two side jambs, the window further comprising at least first and second casements, wherein the first casement includes hinges for rotating it relative to the frame, the hinges being movable relative to the frame along channels provided in the sill and head such that the first casement is slidable within the frame, the first casement also including at least one guide located on the upper and/or lower surface of the first casement distal from the hinges and movable within the respective head or sill channel as the first casement slides relative to the frame, the said at least one guide disengagable from the respective head or sill channel allowing the at least one guide to pass out of the respective channel thus allowing the first casement to be opened relative to the frame, wherein the frame includes a landing strip at the point where the hinge of the first casement is positioned for rotatable opening, the landing strip being located on the sill and including a surface to spread the weight of the first casement across the frame.

The above and other characteristics, features and advantages of the present invention will become apparent from the following detailed description, taken in conjunction with the accompanying drawings, which illustrate, by way of example, the principles of the invention. This description is given for the sake of example only, without limiting the scope of the invention. The reference figures quoted below refer to the attached drawings.

Figure 1:
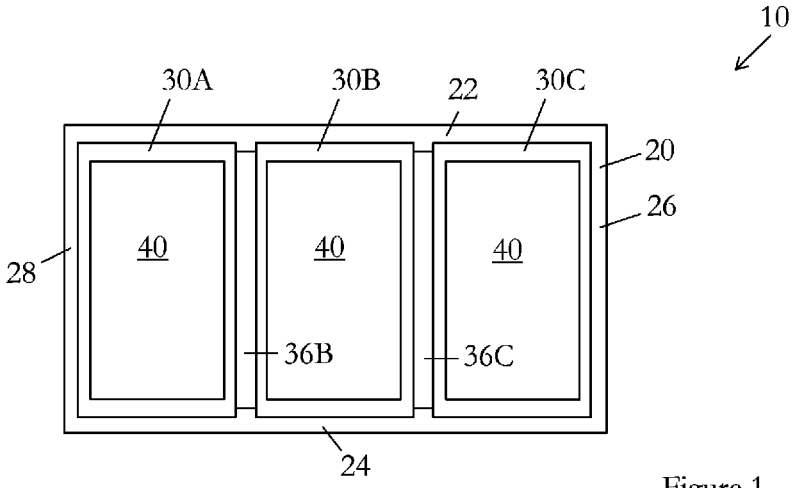
FIG. 1 is a schematic elevation of a window with the casements closed.

The present invention will be described with respect to certain drawings but the invention is not limited thereto but only by the claims. The drawings described are only schematic and are non-limiting. Each drawing may not include all of the features of the invention and therefore should not necessarily be considered to be an embodiment of the invention. In the drawings, the size of some of the elements may be exaggerated and not drawn to scale for illustrative purposes. The dimensions and the relative dimensions do not correspond to actual reductions to practice of the invention.

Furthermore, the terms first, second, third and the like in the description and in the claims, are used for distinguishing between similar elements and not necessarily for describing a sequence, either temporally, spatially, in ranking or in any other manner. It is to be understood that the terms so used are interchangeable under appropriate circumstances and that operation is capable in other sequences than described or illustrated herein.

Moreover, the terms top, bottom, over, under and the like in the description and the claims are used for descriptive purposes and not necessarily for describing relative positions. It is to be understood that the terms so used are interchangeable under appropriate circumstances and that operation is capable in other orientations than described or illustrated herein.

It is to be noticed that the term "comprising", used in the claims, should not be interpreted as being restricted to the means listed thereafter; it does not exclude other elements or steps. It is thus to be interpreted as specifying the presence of the stated features, integers, steps or components as referred to, but does not preclude the presence or addition of one or more other features, integers, steps or components, or groups thereof. Thus, the scope of the expression "a device comprising means A and B" should not be limited to devices consisting only of components A and B. It means that with respect to the present invention, the only relevant components of the device are A and B.

Reference throughout this specification to "an embodiment" or "an aspect" means that a particular feature, structure or characteristic described in connection with the embodiment or aspect is included in at least one embodiment or aspect of the present invention. Thus, appearances of the phrases "in one embodiment", "in an embodiment", or "in an aspect" in various places throughout this specification are not necessarily all referring to the same embodiment or aspect, but may refer to different embodiments or aspects. Furthermore, the particular features, structures or characteristics of any embodiment or aspect of the invention may be combined in any suitable manner, as would be apparent to one of ordinary skill in the art from this disclosure, in one or more embodiments or aspects.

Similarly, it should be appreciated that in the description various features of the invention are sometimes grouped together in a single embodiment, figure, or description thereof for the purpose of streamlining the disclosure and aiding in the understanding of one or more of the various inventive aspects. This method of disclosure, however, is not to be interpreted as reflecting an intention that the claimed invention requires more features than are expressly recited in each claim. Moreover, the description of any individual drawing or aspect should not necessarily be considered to be an embodiment of the invention. Rather, as the following claims reflect, inventive aspects lie in fewer than all features of a single foregoing disclosed embodiment. Thus, the claims following the detailed description are hereby expressly incorporated into this detailed description, with each claim standing on its own as a separate embodiment of this invention.

Furthermore, while some embodiments described herein include some features included in other embodiments, combinations of features of different embodiments are meant to be within the scope of the invention, and form yet further embodiments, as will be understood by those skilled in the art. For example, in the following claims, any of the claimed embodiments can be used in any combination.

In the description provided herein, numerous specific details are set forth. However, it is understood that embodiments of the invention may be practised without these specific details. In other instances, well-known methods, structures and techniques have not been shown in detail in order not to obscure an understanding of this description.

In the discussion of the invention, unless stated to the contrary, the disclosure of alternative values for the upper or lower limit of the permitted range of a parameter, coupled with an indication that one of said values is more highly preferred than the other, is to be construed as an implied statement that each intermediate value of said parameter, lying between the more preferred and the less preferred of said alternatives, is itself preferred to said less preferred value and also to each value lying between said less preferred value and said intermediate value.

The use of the term "at least one" may mean only one in certain circumstances.

The principles of the invention will now be described by a detailed description of at least one drawing relating to exemplary features of the invention. It is clear that other arrangements can be configured according to the knowledge of persons skilled in the art without departing from the underlying concept or technical teaching of the invention, the invention being limited only by the terms of the appended claims.

In FIG. 1, the window 10 comprises a frame 20 including a head 22 at the top, a sill 24 at the bottom, a right hand side 26 and a left hand side 28. Three casements 30A, 30B, 30C are arranged across, and partially within, the frame to form a weatherproof seal. Each casement includes a pane of glass 40. The centre casement 30B and the right hand casement 30C both include mullion portions 36B, 36C on their left hand sides to provide a weatherproof seal between, and to space them apart. FIG. 1 shows the view looking from outside towards the inside of a building in which the window would typically be installed.

In use the left hand casement 30A may be opened in a traditional manner hinged along its left hand side and pivotably opened outwards. The centre casement 30B may then slide along the frame towards the left before being pivoted outwards to lie approximately parallel to the previously opened left hand casement 30A. Finally, the right hand casement 30C may then slide along the frame towards the left before being pivoted outwards to lie approximately parallel to the previously opened left and centre hand casements 30A, 30B.

Figure 2:
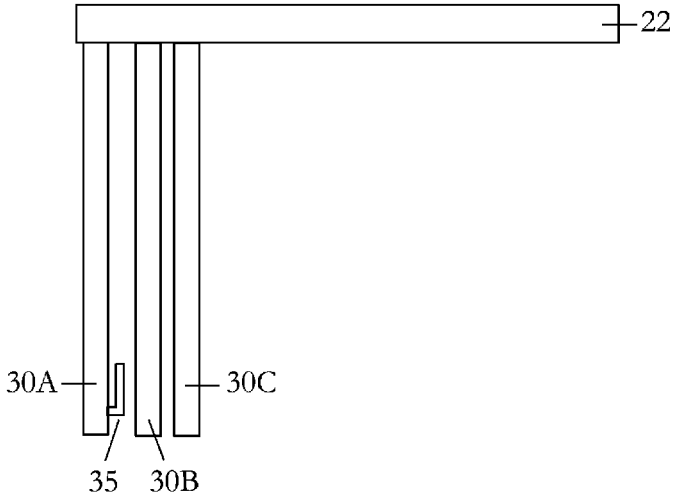
FIG. 2 is a schematic plan of the window of FIG. 1 with the casements in the open and stacked position.

A schematic plan view of the window after the three casements have been opened in this manner is shown in FIG. 2. A handle 35 is shown on the left hand casement 30A as this is typically how that casement will be opened and closed and locked and unlocked. In FIG. 2 the head 22 is visible and each casement 30A, 30B, 30C extends substantially perpendicularly away from the longitudinal length of the head 22; although it is to be understood that the casements could be positioned such that the angle between them and the length of the head 22 is less than 90 degrees. The casements are only shown indicatively and do not include all of the various features such as the mullions 36B, 36C.

Figure 3:
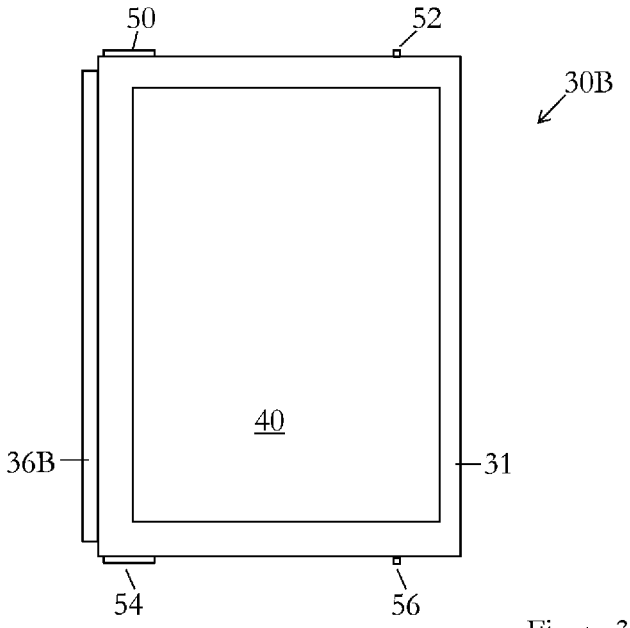
FIG. 3 is a schematic elevation of one casement of the window of FIG. 1.

An elevational view of the centre casement 30B is shown in FIG. 3. The view is looking from the outside to the inside (in other words the casement hinges open, in use, towards the viewer). The casement comprises a rectangular frame 31 within which the pane of glass (or double or triple glazed unit) is held. The frame is a typical casement frame comprising any of uPVC, metals, wood and other such materials.

Along the left hand side ("hinge side") a mullion 36B is provided. This is stepped back from the front face of the casement and provides the spacing between adjacent casements.

An upper hinge 50 is provided on the upper surface of the top of the frame 31 towards the upper left hand corner for allowing the casement to pivot relative to the window frame 20. Likewise, a lower hinge 54 is provided towards the lower left hand corner on the lower surface of the bottom of the frame 20.

A guide 52 is also arranged on the upper surface of the top of the frame towards the upper right hand end corner. Similarly, a guide 56 is arranged on the lower surface of the bottom of the frame towards the lower right hand corner. It is contemplated that in one embodiment only one guide 52, 56 is provided on one of the two outer surfaces of the frame 31. Equally, more than one guide may be provided on one or more outer surfaces of the frame 31.

Figure 4:
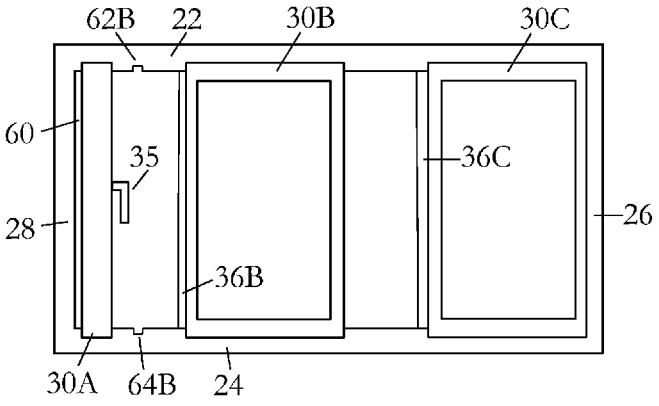
FIG. 4 is a schematic elevation of the window of FIG. 1 with one casement in the stacked open position.

In FIG. 4, the elevational view shows the left hand casement 30A having been fully opened such that the plane of the glass 40 is lying substantially perpendicular to the plane of the glass in the other two unopened casements 30B, 30C.

The handle 35 is visible on the left hand casement 30A.

A gap 60 is visible between the outer face of the opened casement 30A and the left hand side 28 of the window frame 20.

The centre casement 30B has been slid along the window frame 20 towards the left. This is possible due to the hinges 50, 54 being arranged to slide in channels provided in the sill 24 and head 22 of the window frame as will be explained in more detail below.

The mullion 36B which lies between the left hand and centre casements 30A, 30B with the windows all in the closed position is also visible along the left hand side of the casement 30B.

The right hand casement 30C has not yet been moved and is shown in its fully closed position immediately adjacent the right hand side 26 of the window frame 20.

Openings 62B, 64B in the front faces of the channels arranged in the sill 24 and head 22 are visible immediately to the right of the opened left hand casement 30A. These allow the centre casement 30B to pivot relative to the window frame 20 as will be explained in more detail below.

Figure 5:
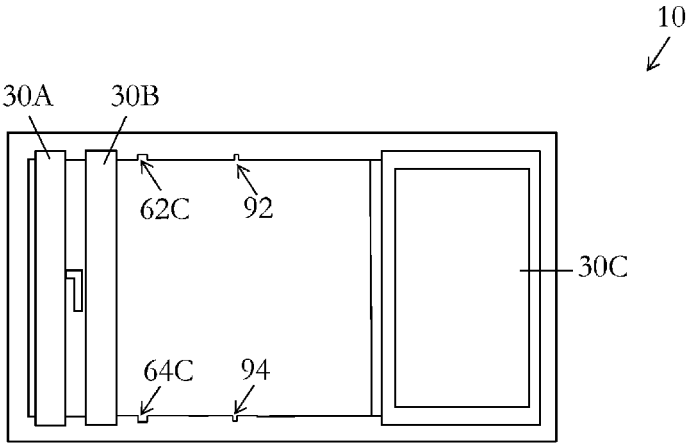
FIG. 5 is a schematic elevation of the window of FIG. 1 with two casements in the stacked open position.

The window 10 with the left hand and centre casements 30A, 30B in their fully open and "stacked" position at the left hand end of the window frame 20 is shown in FIG. 5. In this regard, from the position shown in FIG. 4, the centre casement 30B will have been moved further to the left parallel with the window frame 20 such that its top and bottom hinges 50, 54 will have reached the openings 62B, 64B in the channels. Also, the guides 52, 56 will have reached additional openings (guide slots) 92, 94 provided in the channels in the sill 24 and head 22 such that they can exit the channels. In this way, the centre casement may be pivoted relative to the window frame 20 such that it lies as shown in FIG. 5 being approximately parallel to the already opened left hand casement 30A.

Figure 6:
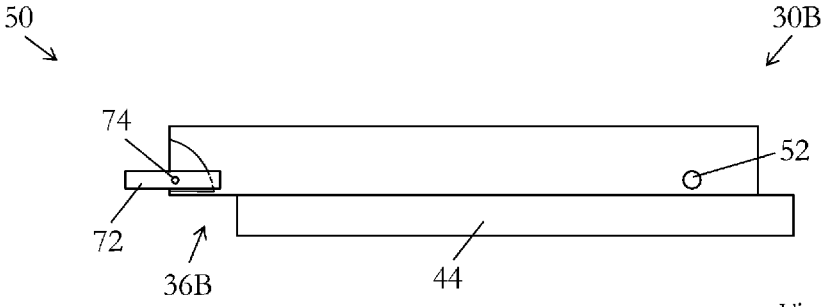
FIG. 6 is a schematic plan of the casement of FIG. 3.

The hinge 50 arranged on the upper surface of the top of the centre casement 30B is shown in plan in FIG. 6. The hinge 50 comprises a quadrant planar member 76 fixed to the upper surface of the casement. It is oriented such that the centre of radius is located towards the outer left hand corner of the casement 30B with the arc lying towards the right and rear of the casement relative to this centre of radius. It may be comprise substantially low friction material to aid the operation of the hinge and to ease the sliding of the casement along the sill 24 and head 22 of the window frame 10.

Affixed to the upper surface of this quadrant is a rectilinear member 72 which is relatively long in a direction parallel to the top of the casement 30B, and having a relatively narrow body in a direction parallel to the thickness of the casement 30B. It is relatively thin in a direction parallel to the height of the casement when installed in a window frame. The rectilinear member 72 is pivotally connected 74 to the quadrant at a point near to the outer left hand corner of the casement and substantially adjacent to, or coincident with, the centre of radius of the quadrant 76.

The rectilinear member 72 is comprised of relatively low friction material to ease the sliding of the casement along the window frame 20.

The mullion portion 36B of the casement 30B is visible on the left of the portion 44 which retains the glass 40. The hinge 50 is shown attached to the mullion portion 36B.

The hinge 54 arranged on the lower surface of the casement 30B comprises an identical arrangement of components.

Also visible on the upper surface of the casement 30B is the guide member 52. It is located towards the right hand end of the upper surface of the casement. An identical one 56 may also be provided on the lower surface of the casement 30B.

Figure 7:
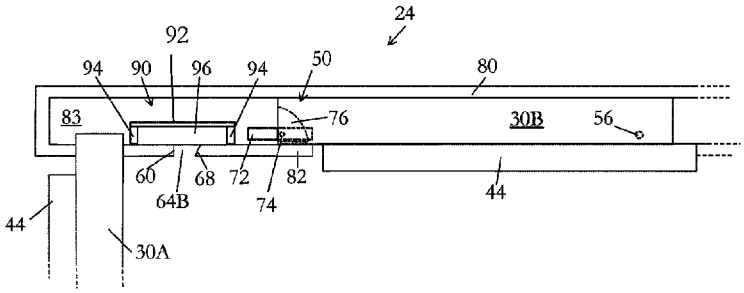
FIG. 7 is a schematic plan one casement in position on the sill.

FIG. 7 provides an indicative plan view of a portion of the window 10. A portion of the sill 24 is visible comprising a rear lip 80 and a front lip 82. These two lips define a channel 83 extending substantially across the width of the sill 24. A similar channel (not shown) is provided in the head 22. Within these two channels the casements 30B, 30C may slide as will be explained below.

In FIG. 7, the left hand casement 30A has already been opened and a portion of it is visible lying approximately perpendicular to the longitudinal length of the sill 24. The outline of the centre casement 30B is indicated to the right of the left hand casement 30A. The lower hinge 54 is shown. The rectilinear member 72 is shown extending out from underneath the casement 30B such that approximately half its length is underneath and half exposed.

A landing strip 90 is arranged within the sill 24. It comprises a surface 96 parallel with, and slightly raised relative to, the base of the channel 83. At each end of the surface 96 are provided ramps 94. At the rear of the surface 96 a wall 92 is provided.

In use, as the casement 30B is moved along the channel 83 the rectilinear member 72 of the hinge 54 will slide up the right hand ramp 94 and then travel along the surface 96. It is expected that the centre casement 30B will then come to rest at this point with the rectilinear member 72 on top of the surface 96 of the landing strip 90.

The landing strip raises the casement relative to the sill 24. This may be desirable to prevent "sagging" of the casement when rotatably opened. The landing strip 90 also provides additional strength to the sill 24 which may only comprise uPVC materials.

Alternatively, the landing strip may not include ramps and may not raise the casement. Rather, it may act to spread the load of the casement to prevent deformation of the sill as the casement is pivoted outwards relative to the frame.

Figure 8:
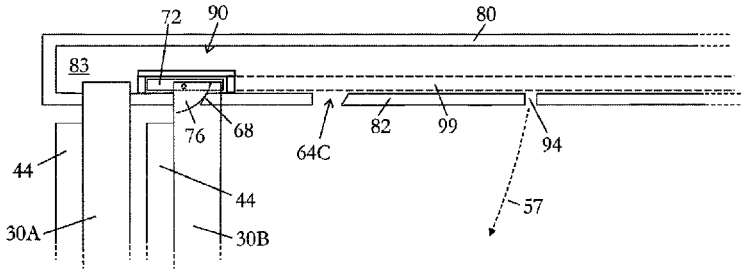
FIG. 8 is a schematic plan of the casement of FIG. 7 in the stacked position on the sill.

In FIG. 8 the casement 30B is shown as having been pivotably opened relative to the window frame 20. As it opens the rectilinear member 72 remains substantially stationary within the reduced width channel formed by the rear wall 92 of the landing strip 90 and the front lip 82 of the sill 24.

However, the quadrant 76 has rotated with the casement 30B relative to the window frame 20 and at least partially extended through an opening 64B provided within the front lip 82 forming the channel 83.

The left hand side 66 of the opening 64B lies perpendicularly to the longitudinal length of the sill 24. The right hand side 68 of the opening, however, lies at approximately 45 degrees to the longitudinal length of the sill 24. It is seen how this right hand side at least partially presses against the perimeter of the quadrant 76 with the casement in the open position. This provides some support to the hinge 54. It is possible that the right hand side 68 of the opening is curved to more closely match the arc of the perimeter of the quadrant member 76.

The upper hinge 50 also operates in the same manner as the lower hinge 54 with respect to the head 22 of the frame 20.

With the centre casement 30B in the open "stacked" position shown in FIG. 8 an opening 94 in the side of the channel 83 is visible. Previously it was hidden by the casement 30B in the closed (pre-pivoting) position. This opening 94 allows the guide member 56 to exit the channel 83, as the casement is pivoted open relative to the window frame 10, in an arc as indicated by reference "57" in FIG. 8.

The same opening 94 can also be used with the right hand casement 30C. However, the position of the guide member on the lower surface of the casement 30C, relative to the bottom hinge on the same casement 30C will be different to that of the centre casement 30B to accommodate the different distance between the hinge slot 64B and guide slot 94, and the hinge slot 64C and guide slot 94. This will be the same for the position of the guide member on the upper surface of the centre casement 30C. In this way, the same guide slots 92, 94 can be used with both the centre and right hand casements.

In a similar manner, if more than three casements are provided the subsequent casements may also use the same guide slots 92, 94 as long as the respective guide members are positioned relative to their hinges to match the distance between the relevant hinge slots and the guide slots 92, 94.

However, it is preferable not to position the guide members at positions less than half the width of the casement from the hinges as this may reduce security and the ease with which the casements slide. If the number of casements is above a number whereby the distance of the guide members would have to be less than half the width of the casement then additional guide slots (not shown) may be provided in the head or sill channels.

The hinge opening 64C in the front lip 82 of the sill 24 is visible in FIG. 8. Previously it was also hidden by the casement 30B in the closed (pre-pivoting) position. This opening 64C will allow the right hand casement 30C to pivotably open relative to the frame 20 in a similar manner as the centre casement 30B such that it may also be "stacked" against the other two casements and in this way substantially fully open the window 10. In other words, the right hand casement 30C (not shown) may be slid along the sill 24 until its lower hinge meets the opening 64C. At this point, the casement may be pivoted relative to the window frame 20.

This is effected by the guide member on the casement 30C passing through the same opening 94 in the side of the channel 83 in the sill 24. This opening 94 allows the guide member on the underside of the casement 30C to exit the channel 83 in an arc 57.

In FIG. 8 a track 99 is indicated in the base of the channel 83. This track may comprise relatively low friction material to aid the sliding of the rectilinear member 72 therealong. Other arrangements such as ball-bearings and wheels are contemplated to be provided between the base of the casements and the base of the channel.

The arrangement of openings 64B, 64C, 94 in the channels 83 may be arranged such that each casement has its own set of openings to allow the hinges and guide members to exit the channels.

To close the windows the reverse procedure is performed. In other words, the casements are pivoted back towards the window frame 20 such that the guide members and hinges may re-enter the channels. The casements may then be slid along the sill 24 to the required position. Finally, the left hand casement 30A may be pivoted back towards the closed position and then locked shut with a locking handle in a similar manner to conventional uPVC double glazed windows. With the left hand casement 30A in the locked and closed position none of the other casements may be opened.

In one embodiment, there may be more than the three casements described with reference to these Figures. They may be slid and pivoted relative to the window frame in the same manner as described above such that more than three casements are stacked up at one end.

It will be understood that the arrangement of the left hand casement may be applied to a right hand casement as well as, or instead of, the left hand casement described above. In other words, the casements may be arranged to stack at the right hand end of the window frame 20.

Alternatively or additionally, the window 10 may be arranged such that the casements stack in a position intermediate between the right and left hand ends.

Alternatively or additionally, the window 10 may be arranged such that the both the right and left hand casements are only openable in a pivoting manner and not slidable, relative to the window frame 20, with the intermediate casements being arranged to be stacked at either or both ends of the frame 20.

Alternatively or additionally, the window 10 may be arranged such that the casements pivot inwards relative to the building in which the frame 20 is installed. In this regard, the openings 64B, 64C, 92, 94 would be located on the wall of the channel closest to the inside of the building (i.e. the rear of the channel).

In the Figures, some features which are obscured by other features are shown in dashed lines to provide greater clarity. For instance, the quadrant 76 in FIG. 7 is shown with a dashed line as it would not be visible in this plan view as it is underneath the casement.

The term "hinge" may also mean a "pivot".

The invention may not include any wheels to aid the movement of the casement(s) relative to the frame.

Furthermore, the casements may not tilt about a horizontal axis. The casements may remain at all times with the glass in a vertical plane.

The term "window" used through out this specification also includes doors.

Figure 9:
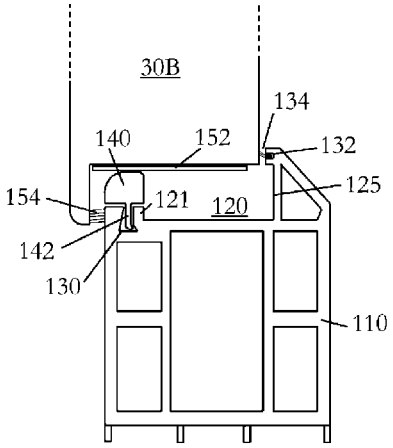
FIG. 9 is a cross-sectional elevational view of a window frame and casement.

In FIG. 9, a cross-section through a typical uPVC window (sill) frame 110 is depicted schematically, comprising a rectangular outer wall and internal chambers providing structural rigidity.

At the top of the frame a socket 130 is provided in the form of a groove running along the length thereof. A runner 140 having an approximately rectangular cross-section is attached to the top of the frame 110 via a semi-flexible tongue depending from its underside and pushed into the groove 130.

The runner 140 and a wall 125 upstanding from the top of the frame between them define a channel 120.

At the top of the wall 125 a brush 134 member may be held in another grove 132 for allowing the casement to move relative to the frame but substantially preventing ingress of dirt and the like therebetween.

A casement 30B is arranged above the frame (the lower portion being shown only). It includes a plate 152 of low friction material attached to its underside. More than one such plate may be provided.

The plate 152 rests on top of the runner 140 such that the movement of the casement therealong is eased.

A brush 154 is provided between the inside front edge of the casement and the side of the frame 110 immediately below the runner 142 to provide a seal against the ingress of dirt and the like therebetween.

Figure 10:
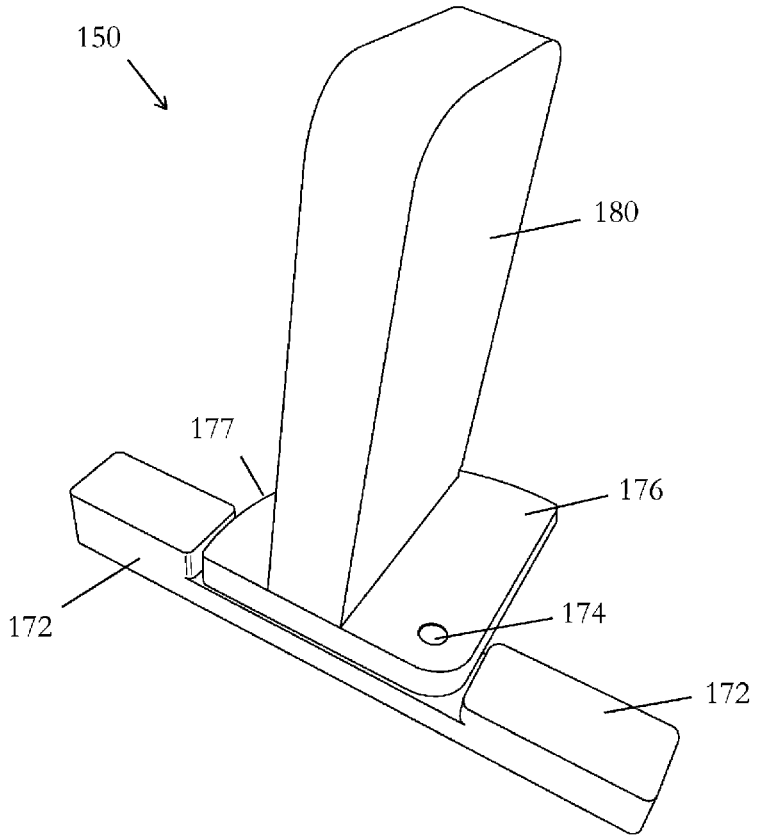
FIG. 10 is perspective view of a hinge.

A hinge 150 is depicted in FIG. 10 comprising a rectilinear section 172 in the form of an oblong having a recess in the top central area into which a quadrant 176 is pivoted 174 towards one end thereof. The quadrant has a thickness approximately equal to the depth of the recess.

A block 180 projects upwardly from a central area of the planar quadrant 176. In use, the block is attached to the side of the casement 30B, or to a mullion portion if one is attached to, or forms part of, the casement, such that the quadrant portion is arranged on the underside thereof. The casement 30B is thus rotatable about the pivot 174. As the quadrant 176 rotates, its outer curved portion 177 moves past one of the blocks 172.

The rectilinear portion 172 may travel along the channel 120 in the frame 110. However, the quadrant may not rotate relative to the rectilinear portion 172 until in the correct position along the length of the frame because the runner 140 will be in the way. Consequently, the casement may not be rotated either.

Figure 11:
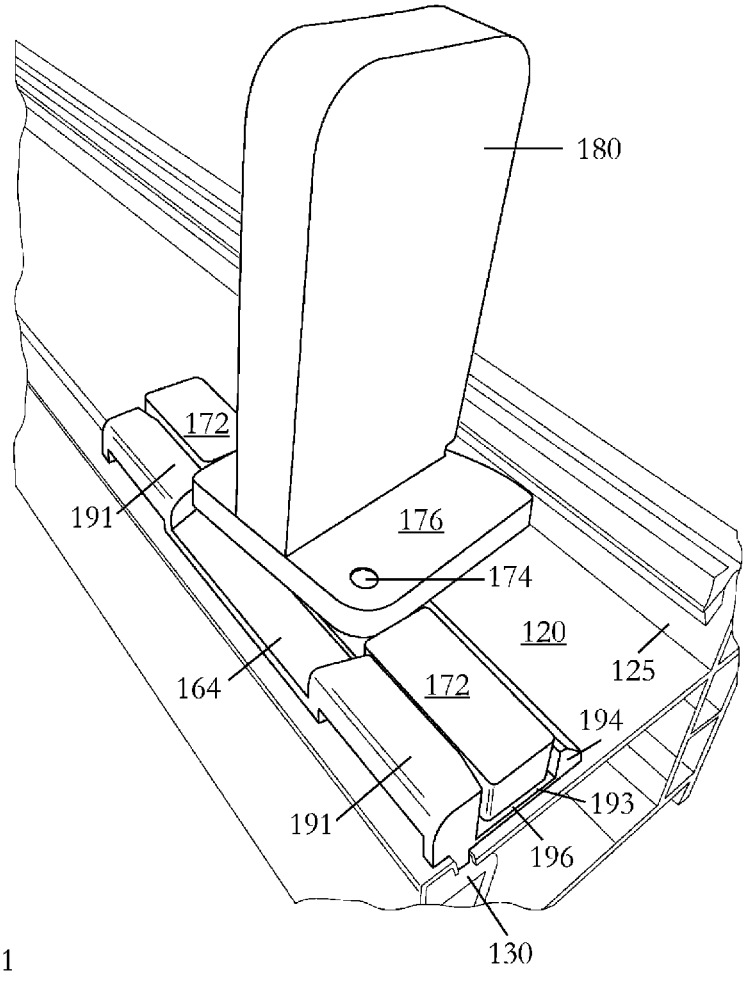
FIG. 11 is a perspective view of the hinge of FIG. 11 in association with a gate on a window frame.

However, with the casement in the correct position the quadrant 176 may rotate. Such a position is shown in FIG. 11 where the hinge 150 has reached a gate 190. The gate 190 takes the place of the runner 140 and in this region no runner 140 is present.

The gate 190 comprises a front edge which projects upwardly from the top of the frame in a similar location to where the runner 140 is located further along the frame. The gate 190 may be anchored to the frame by means of a downwardly depending tongue into the groove 130 in a similar manner to the runner 140.

An opening 164 is provided centrally in the front edge 191 having a width to accept the quadrant as it rotates about pivot 174.

Extending from the edge towards the wall 125 of the frame 110 and parallel to the top of the frame is flat section 193. At the end of this flat section 193 is a small upstanding portion 194. Between the upstanding section 194 and the front edge 191 a channel 196 is defined having the flat section 193 as its base.

With the hinge in the correct position, the rectilinear portion 172 has passed into this channel 196 formed by the upstanding section 194, front edge 191 and base 193. The width of the channel 196 is approximately equal to the width of the rectilinear portion 172 such that it is supported thereby.

The quadrant 176 may be rotated such that it extends into the opening 164. The casement 30B may thus be rotated through 90 degrees.

Figure 12:
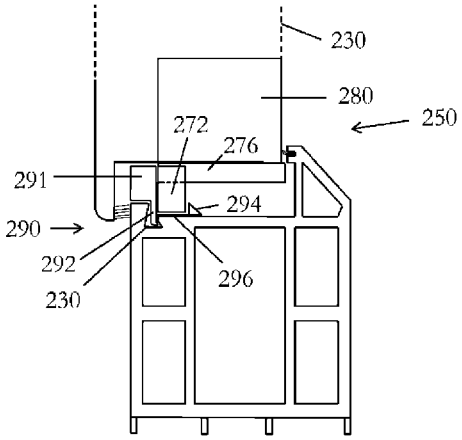
FIG. 12 is a schematic elevational end view of the window frame and casement of FIG. 9 with the hinge and gate of FIGS. 10 and 11.

A schematic end view of a similar hinge 250 attached to the side of a similar casement 230 is shown in FIG. 12. The block 280 is attached to the side of the casement 230 or to a mullion portion if one is attached to, or forms part of, the casement. Only the lower portion of the casement/mullion is shown. The quadrant 276 is arranged underneath the casement 230 (or mullion portion). The rectilinear portion 272 is arranged in the channel 296 formed between the upstanding section 294 and the front edge 291.

The gate 290 is held in place by the downwardly depending tongue 292 arranged in the groove 230. Other ways of affixing the gate are contemplated such as gluing or screwing.

As the casement is rotated about a vertical axis the quadrant 276 pivots with it towards the front edge of the casement 230 such that it extends through the gap 164 behind the front edge 291.

The invention claimed is:

1. A window comprising a frame including a head and a sill, each comprising a channel, the window further comprising at least first and second casements, wherein the first casement includes a hinge for rotating the first casement relative to the frame, the hinge being movable relative to the frame along the sill channel such that the first casement is slidable within the frame, the first casement also including an upper surface and a lower surface, and at least one guide located on the upper and/or lower surface of the first casement distal from the hinge and movable within the respective head or sill channel as the first casement slides relative to the frame, the at least one guide disengagable from the respective head or sill channel allowing the at least one guide to pass out of the respective channel thus allowing the first casement to be opened relative to the frame, the sill including a runner on which the casement is slidable, wherein the frame includes a landing strip at a location where the hinge of the first casement is positioned for rotatable opening, the landing strip including a surface to spread the weight of the first casement across the frame, and wherein the hinge comprises a first part having a quadrant shape and a second part having a rectilinear portion, wherein the first and second parts are pivoted to one another and the first part is arrangeable on the lower surface of the first casement and the second part is movable along the sill channel, and wherein the landing strip comprises a sidewall to reduce the width of the sill channel such that it is approximately equal to the width of the second part.

2. The window according to claim 1, wherein the runner is metallic.

3. The window according to claim 1, wherein the runner is located outwardly of the channel.

4. The window according to claim 1, wherein the runner is inserted into a groove in the sill.

5. The window according to claim 1, wherein the sill channel has a base and the runner is arranged to raise the first casement away from the base of the sill channel.

6. The window according to claim 1, further comprising at least one sliding surface of material comprising relatively low friction, compared to the runner, to ease the sliding of the first casement relative thereto.

7. The window according to claim 1, the frame includes at least one hinge slot in the side wall of the sill channel for allowing the first part of the hinge to pass at least partially out of the sill channel as the casement is opened.

8. The window according to claim 7, wherein one side of the sill channel is formed by the runner and the hinge slot in the side of the sill channel is formed by an absence of the runner.

9. The window according to claim 7, comprising a glass pane, wherein the hinge slot includes a side wall lying at an angle less than 80 degrees relative to a plane parallel with the surface of the glass pane.

10. The window according to claim 9, wherein a side of the quadrant shape is supported by the sidewall as the first casement is opened.

11. The window according to claim 9, wherein a reinforcing gate member is inserted into the hinge slot.

12. The window according to claim 11, wherein the reinforcing gate member includes a side wall, and the side wall of the hinge slot is replaced by the side wall of the reinforcing gate member.

13. The window according to claim 11, wherein the reinforcing gate member and the landing strip are unitary.

14. The window according to claim 7, comprising a glass pane, wherein the hinge slot includes a curved sidewall relative to a plane parallel with the surface of the glass pane.

15. The window according to claim 1, comprising a third casement wherein each of the at least first and second casements, and the third casement is openable by approximately 90 degrees relative to the frame, such that the casements are positionable immediately adjacent one another so as to provide an opening in the frame.

* * * * *